US006182642B1

(12) United States Patent
Ohkuma

(10) Patent No.: US 6,182,642 B1
(45) **Date of Patent: *Feb. 6, 2001**

(54) LEAK DETECTION OF EMISSION CONTROL SYSTEM

(75) Inventor: Shigeo Ohkuma, Tochigi (JP)

(73) Assignee: Unisia Jecs Corporation, Atsugi (JP)

( * ) Notice: Under 35 U.S.C. 154(b), the term of this patent shall be extended for 0 days.

(21) Appl. No.: 09/439,992

(22) Filed: Nov. 15, 1999

(30) Foreign Application Priority Data

Nov. 16, 1998 (JP) ..... 10-325459

(51) Int. Cl.[7] ..... F02M 33/02
(52) U.S. Cl. ..... 123/520; 123/519
(58) Field of Search ..... 123/516, 518, 123/519, 520, 198 D

(56) References Cited

U.S. PATENT DOCUMENTS

| | | | | |
|---|---|---|---|---|
| 5,146,902 | * | 9/1992 | Cook et al. | 123/520 |
| 5,273,020 | * | 12/1993 | Hayami | 123/520 |
| 5,349,935 | * | 9/1994 | Mezger et al. | 123/520 |
| 5,411,004 | * | 5/1995 | Busato et al. | 123/520 |
| 5,575,265 | * | 11/1996 | Kurihara et al. | 123/520 |
| 5,890,474 | * | 4/1999 | Schnaibel et al. | 123/520 |
| 5,975,062 | * | 11/1999 | Bonse et al. | 123/519 |

FOREIGN PATENT DOCUMENTS 5-215020 8/1993 (JP) .

* cited by examiner

*Primary Examiner*—Thomas N. Moulis
(74) *Attorney, Agent, or Firm*—Foley & Lardner

(57) ABSTRACT

A leak detection apparatus for an evaporative emission control system is provided. By the apparatus, a current through a motor driven air pump is detected and determined as a judgment level when the air pump is ON and a directional control valve is in a position of connecting a fresh air inlet of a canister to an atmospheric vent, for thereby allowing air from the air pump to pass through a reference orifice of a bypass conduit and thereafter be released to the open air through the directional control valve. Then, it is established a condition in which the air pump is ON and the directional control valve is in a position of connecting the fresh air inlet to an outlet of the air pump so that air from the air pump passes through the directional control valve and the fresh air inlet of the canister and is supplied to the purge line, and this condition is maintained for a predetermined time. The predetermined time is made shorter as the temperature of fuel detected by a fuel temperature sensor is higher and a tank residual detected by a tank residual sensor is larger. At a measurement timing after lapse of the predetermined time, the current through the air pump is measured and determined as a leak level. When the leak level is lower than the judgment level, it is determined that a leak is present in the evaporative emission control system, i.e., a leak is present in a fuel vapor flow passage extending from a fuel tank to a purge control valve by way of the canister. A method of detecting a leak in an evaporative emission control system is also provided.

16 Claims, 8 Drawing Sheets

LEAK DETECTION OF EMISSION CONTROL SYSTEM

BACKGROUND OF THE INVENTION

1. Field of the Invention

The present invention relates in general to evaporative emission control systems for automotive vehicles and more particularly to an apparatus for determining if a leak is present in an evaporative emission control system for an automotive vehicle. The present invention further relates to a method of detecting such a leak.

2. Description of the Related Art

A prior art evaporative emission control system for an automotive vehicle prevents emission of evaporative fuel to the open air by introducing the fuel vapors produced in a fuel tank to a canister so that the fuel vapors are temporarily absorbed by the canister, and supplying the collected fuel vapors to an intake system of an engine together with fresh air drawn into the canister through its atmospheric vent, as disclosed in Japanese Patent Provisional Publication No. 5-215020.

In the meantime, if there should occur, in the above described evaporative emission control system, a crack and the like in a fuel vapor flow passage extending from the fuel tank through the canister to a purge valve, the fuel vapors leak, resulting in that the evaporative emission control system is no more operative to produce an expected effect of preventing evaporative emission sufficiently.

Thus, it has been proposed such a leak detection method for detecting if a leak is present in the fuel vapor flow passage or not.

By the method, a current through a motor driven air pump (hereinafter also referred to as pump operating current) when air is forced to pass a reference orifice of a reference bore size by the air pump is detected and determined as a criterion or judgment level. On the other hand, a pump operating current at the time air is forcedly transmitted to the fuel vapor flow passage of the evaporative emission control system by the air pump while bypassing the reference orifice is measured and determined as a leak level. By comparing the leak level with the judgement level, it is determined that a leak is present in the evaporative emission control system when the leak level is smaller than the judgement level.

This method enables to detect a leak accurately and assuredly even when the leak results from a small hole in the fuel vapor flow passage, i.e., even when the leak is small.

However, the above described method has a problem that the pressure of evaporative fuel in the fuel tank is high when the temperature of fuel in the fuel tank is high, so the pump operating current is increased by the influence of increase of pressure in the fuel tank even when the fuel vapor flow passage has such a hole or the like that will cause a detectable leak, resulting in the possibility that a leak that is actually present is erroneously judged as no leak. Further, in case the residual quantity of fuel in the fuel tank (hereinafter also referred to as tank residual) is large, such a possibility is enhanced.

SUMMARY OF THE INVENTION

It is accordingly an object of the present invention to provide a leak detection apparatus for an evaporative emission control system which can solve the above noted problem inherent in the prior art apparatus.

It is a further object of the present invention to provide a leak detection apparatus of the foregoing character which can exclude the influence of fuel temperature and tank residual on leak detection or diagnosis assuredly and can improve the detection or diagnosis accuracy.

It is a still further object of the present invention to provide a leak detecting method which is free from the above noted problems inherent in the prior art method.

To achieve the foregoing objects, the present invention provides an apparatus for detecting a leak in an evaporative emission control system for an internal carbustion engine including a fuel tank, a canister for collecting fuel vapors from the fuel tank and having a fresh air inlet, and a purge control valve disposed between the canister and an intake pipe for controlling flow of the fuel vapors from the canister to the intake pipe together with fresh air drawn into the canister through the fresh air inlet such that a fuel vapor flow passage is provided which extends from the fuel tank to the purge control valve by way of the canister. The apparatus comprises means for defining an atmospheric vent in communication with the open air, a motor driven air pump having an outlet, a directional control valve capable of connecting the fresh air vent selectively to one of the atmospheric vent and the outlet of the air pump, a bypass conduit providing communication between the fresh air inlet and the outlet of the air pump while bypassing the directional control valve, the bypass conduit having a reference orifice, judgment level determining means for detecting, when the air pump is ON and the directional control valve connects the fresh air inlet to the atmospheric vent, for thereby allowing air from the air pump to pass through the reference orifice of the bypass conduit and thereafter be released to the open air through the directional control valve, a first current through the air pump and determining the first current as a judgment level, leak level measuring means for measuring, at a measurement timing after lapse of a predetermined time from establishment of a condition in which the air pump is ON and the directional control valve connects the fresh air inlet to the outlet of the air pump so that air from the air pump passes through the directional control valve and the fresh air inlet of the canister and is supplied to the fuel vapor flow passage, a second current through the air pump and determining the second current as a leak level, leak judging means for comparing the leak level with the judgment level and judging if a leak is present in the fuel vapor flow passage, fuel temperature detecting means for detecting a temperature of fuel in the fuel tank, and measurement timing variable determining means for determining the measurement timing variably on the basis of the temperature of fuel.

BRIEF DESCRIPTION OF THE DRAWINGS

FIGS. 7A and 7B are graphs illustrating a pump operating current as a function of time, wherein FIG. 7A is a normal case with respect to fuel temperature and tank residual and FIG. 7B is a case the fuel temperature is high and the tank residual is large.

DESCRIPTION OF THE PREFERRED EMBODIMENTS

Figure 1:
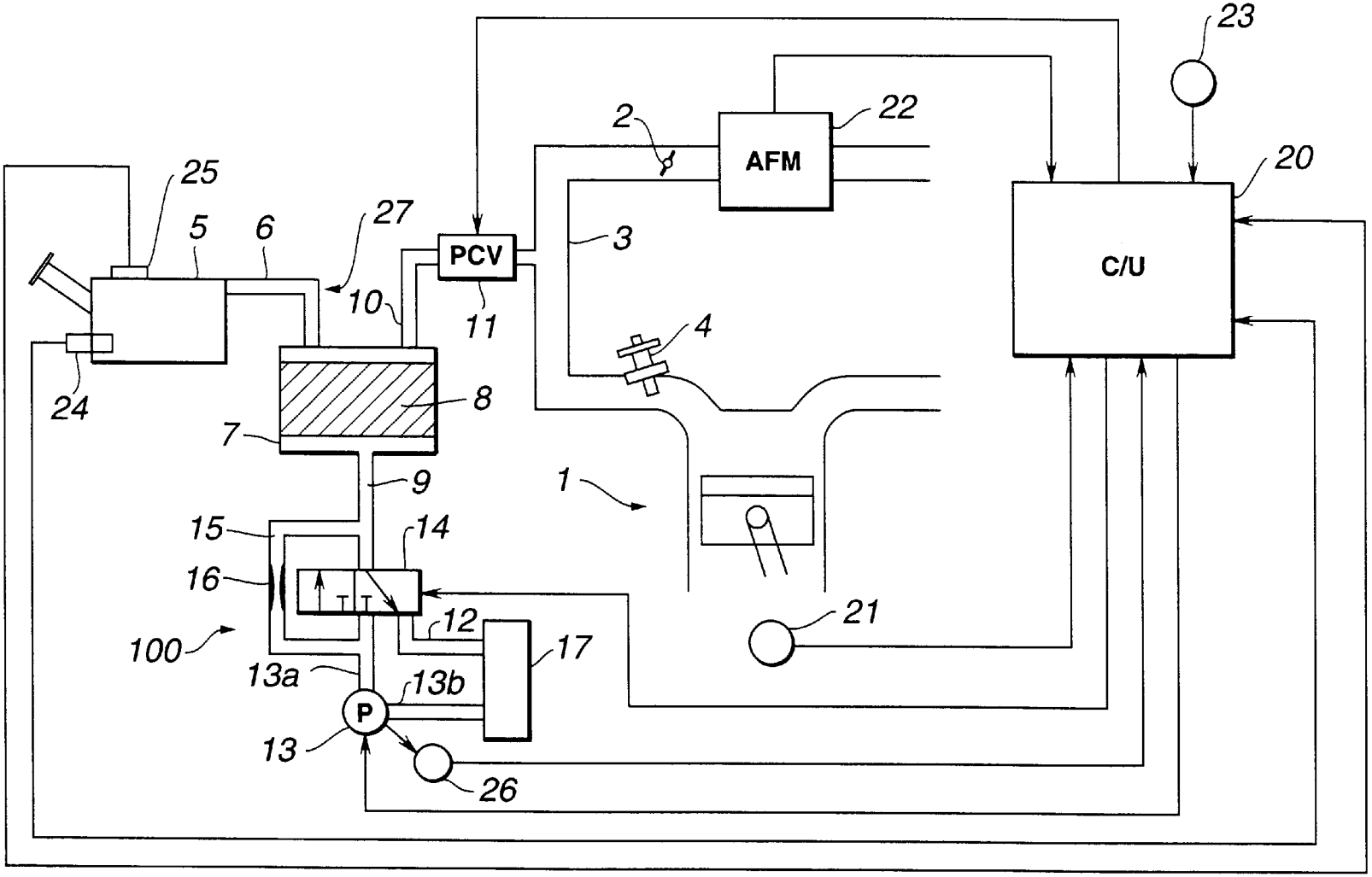
FIG. 1 is a schematic diagram of an evaporative emission control system utilizing a leak detection apparatus, according to an embodiment of the present invention.

Referring first to FIG. 1, a leak detection apparatus according to an embodiment of the present invention will be described. In FIG. 1, an internal combustion engine is generally indicated by 1. An intake system of the engine 1 is provided with a throttle valve 2 for controlling the quantity of intake air. At each manifold portion of an intake pipe 3 downstream of the throttle valve 2 there is provided an electromagnetic fuel injector 4 for each cylinder of the engine 1. The fuel injector 4 is opened to inject fuel in response to a driving pulse signal which is outputted by a control unit 20 in timed relation to engine speed. The injected fuel is combusted within a combustion chamber of the engine 1.

An evaporative emission control system includes a canister 7 for drawing thereto fuel vapors produced in a fuel tank 5 through a fuel vapor drawing conduit 6 and temporarily absorbs the fuel vapors. The canister 7 consists of an absorbent 8 such as an activated charcoal filled in a casing.

The canister 7 has a fresh air inlet 9 and is connected to a portion of the intake pipe 3 downstream of the throttle valve 2 by way of a purge control valve 11. The purge control valve 11 opens in response to a signal outputted by the control unit 20.

By the above described structure, the fuel vapors produced in the fuel tank 5 during the time the engine 1 is not running are drawn through the fuel vapor drawing conduit 6 to the canister 7 and absorbed by the canister 7. When the engine 1 starts running and a predetermined purge permitting condition is established, the purge control valve 11 opens and an intake vacuum of the engine 1 acts upon the canister 7. As a result, fresh air is drawn through the fresh air inlet 9 into the canister 7, thus causing the fuel vapors to be drawn from the canister 7 and through a purge conduit 10 together with the fresh air into the intake pipe 3 for combustion in the combustion chamber in the engine 1.

The evaporative emission control system is provided with a leak detection apparatus 100 which is provided to the fresh air inlet 9 of the canister 7.

The leak detection apparatus 100 includes an atmospheric vent 12 and communicable with the fresh air inlet 9, and an electric air pump 13. An electromagnetic directional control valve 14 is provided which selectively connects the fresh air inlet 9 to one of the atmospheric vent 12 and an outlet 13*a* of the air pump 13. A bypass conduit 15 is provided which bypasses the directional control valve 14 and provides communication between the fresh air inlet 9 and the outlet 13*a* of the air pump 13. The bypass conduit 15 is provided with a reference orifice 16 of a reference bore size (e.g., 0.5 mn). An air filter 17 is provided to the atmospheric vent 12 and an inlet 13*b* of the air pump 13.

The directional control valve 14 takes a position for connecting the fresh air inlet 9 to the atmospheric vent 12 when it is OFF and a position for connecting the fresh air inlet 9 to the air pump 13 when it is ON. The directional control valve 14 is normally held in an OFF position providing communication between the fresh air inlet 9 and the atmospheric vent 12.

The control unit 20 includes a microcomputer which is made up of CPU, ROM, RAM, A/D converter, input/output interface, etc. and is supplied with signals from various sensors.

Such various sensors include a crank angle sensor 21 for outputting a crank angle signal in timed relation to the operation of the engine 1 and thereby capable of detecting engine speed, an air flow meter 22 for measuring a quantity of intake air, a vehicle speed sensor 23 for detecting vehicle speed, a fuel temperature sensor 24 serving as a fuel temperature detecting means for detecting the temperature of fuel in the fuel tank 5, a residual fuel sensor 25 serving as a tank residual detecting means for detecting the residual quantity of fuel in the fuel tank 5, and an electric current sensor 26 for detecting a current for through the air pump 13, i.e., a pump operating current.

The control unit 20 controls the operation of the fuel injectors 4 and the operation of the purge control valve 11 in dependence upon the operating conditions of the engine 1. Further, after stopping of the engine 1, the air pump 13 and the directional control valve 14 which constitute part of the leak detection apparatus 100 are operated so as to excute a leak diagnosis or detection of the evaporative emission control system.

For such leak detection of the evaporative emission control system, the control unit 20 has a software for providing a judgement level determining means, a leak level measuring means, a leak judging means, and a measurement timing variable determining means.

Figure 2:
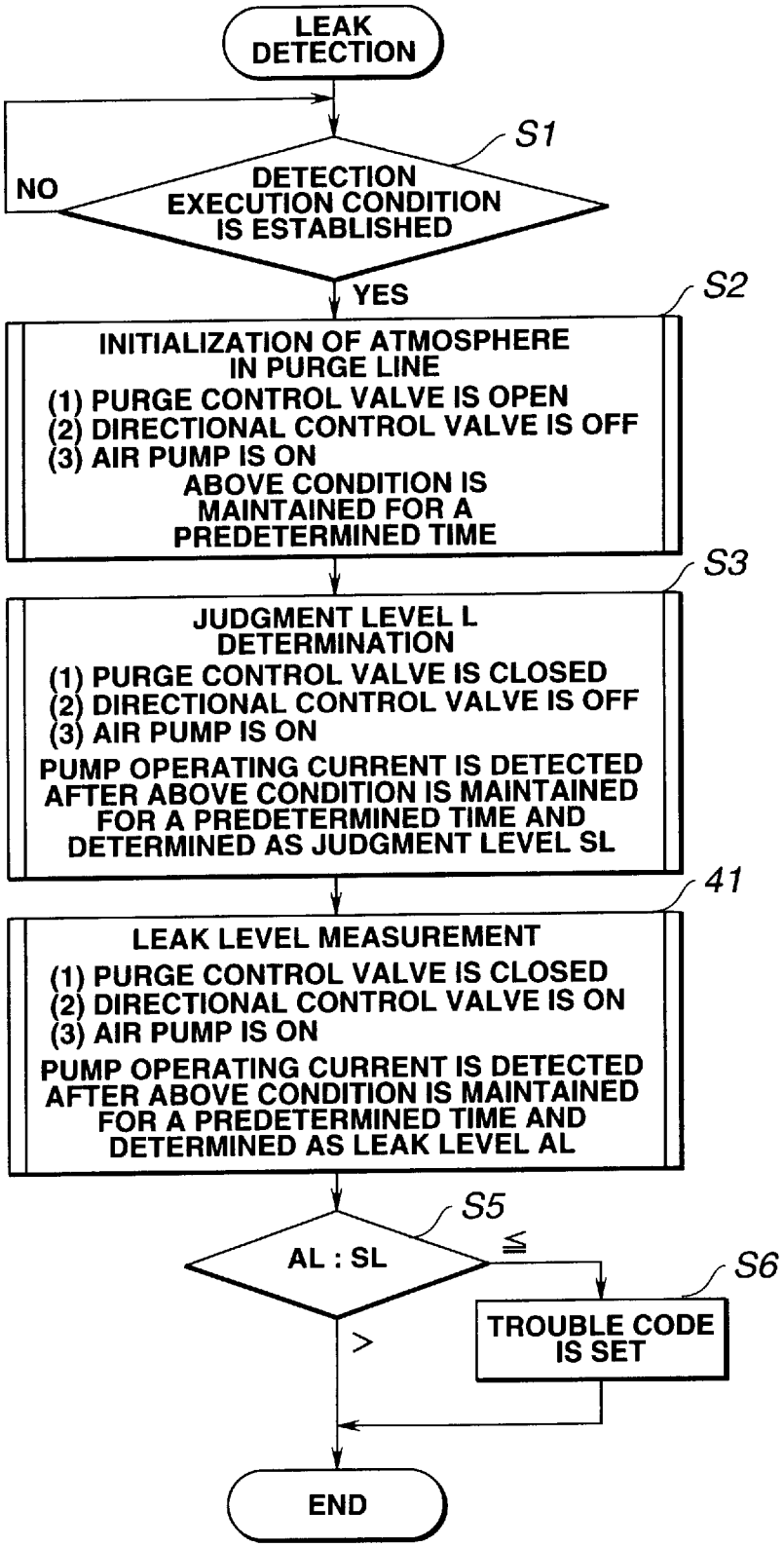
FIG. 2 is a flowchart illustrating a routine for leak detection executed by the apparatus of FIG. 1.

The leak detection of the evaporative emission control system by means of the control unit 20 will be described with reference to the flowchart of FIG. 2. The program starts after an engine key is switched from ON to OFF.

At step S1, it is judged if a predetermined detection executing condition is established, i.e., all of the following conditions (1)–(5) are established.

(1) engine speed≦predetermined value (2) vehicle speed≦predetermined value (3) The purge control valve 11 is judged as functioning properly by means of a malfunction detecting routine which is executed separately.

(4) temperature of fuel≦predetermined value (5) lower limit value≦tank residual≦upper limit value When it is judged that the above requirements are met, the program proceeds to step S2.

At step S2, initialization of the atmosphere in the purge conduit 10 is carried out. Specifically, ① the purge control valve 11 is opened, ② the directional control valve 14 is OFF to assume an operative position of connecting the fresh air inlet 9 to the atmospheric vent 12, and ③ the air pump 13 is ON. This condition is maintained for a predetermined time.

Figure 4:
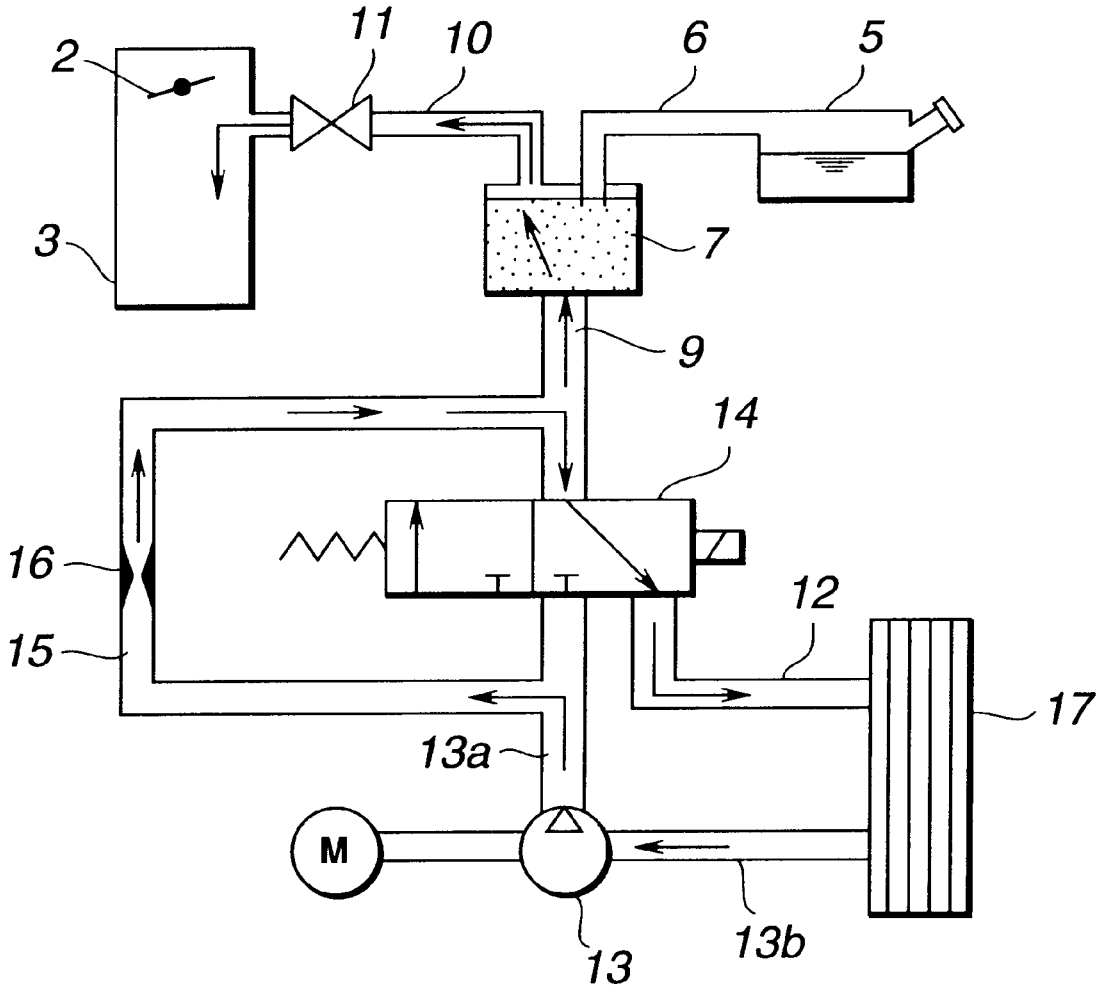
FIG. 4 a schematic diagram illustrating flow of air in a purge line of the emission control system of FIG. 1 when the atmosphere in the purge line is initialized.

When this is the case, as shown in FIG. 4, air drawn into the air pump 13 and then discharged therefrom passes through the bypass conduit 15, the fresh air inlet 9 of the canister 7, the inside of the canister 7 and the purge control valve 11 at the purge conduit 10 and flows into the intake pipe 3. Further, a portion of air flows backward through the directional control valve 14, after passing the bypass conduit 15, and is discharged from the atmospheric vent 12 into the open air.

As a result, the residual pressure (negative pressure) and the residual gas in the purge conduit 10 is removed.

Then, at step S3, a judgment level for leak detection is determined. Specifically, ① the purge control valve 11 is closed, ② the directional control valve 14 is OFF to assume an operative position of connecting the fresh air inlet 9 to the atmospheric vent 12, and ③ the air pump 13 is ON. This condition is maintained for a predetermined time.

Figure 5:
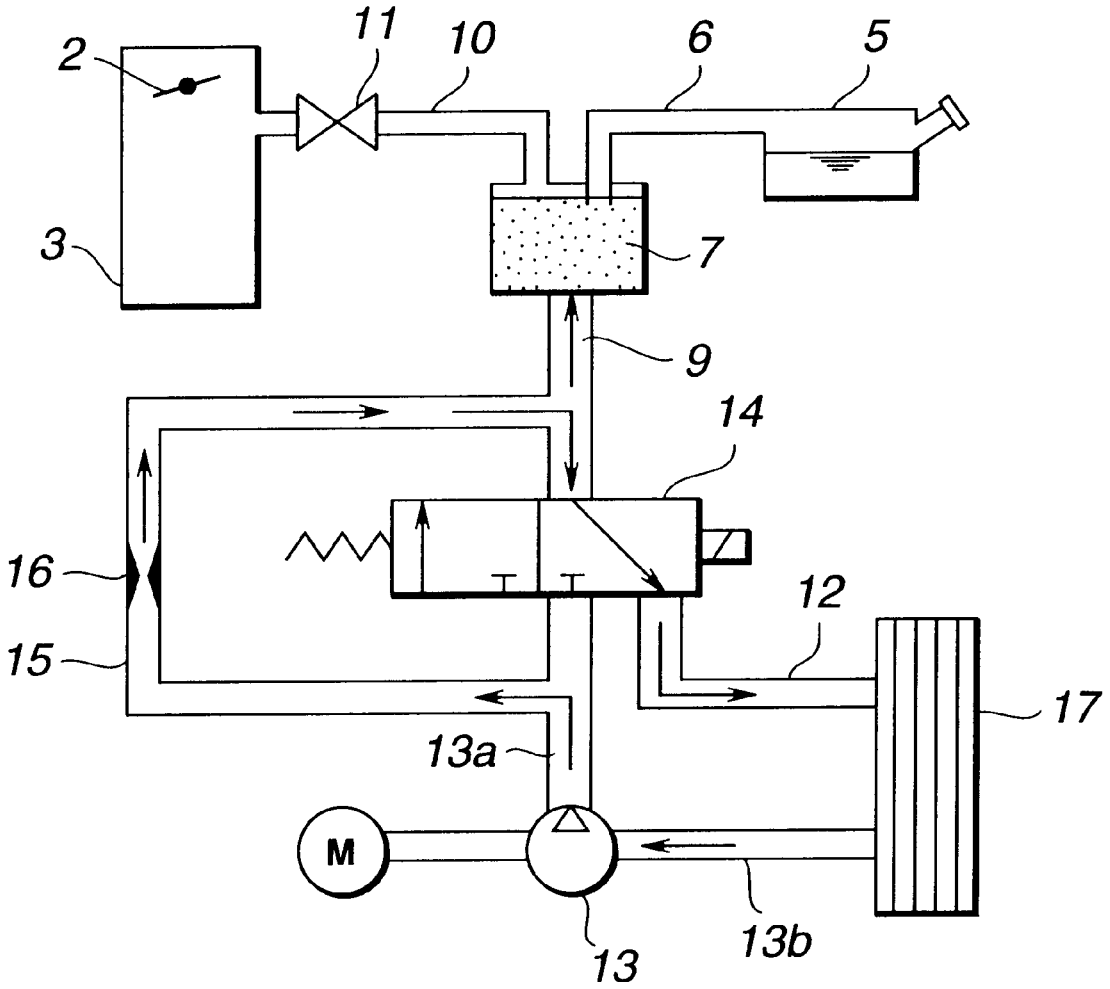
FIG. 5 is a view similar to FIG. 4 but shows flow of air when a judgment level is determined.

When this is the case, as shown in FIG. 5, air drawn into the air pump 13 and discharged therefrom flows backward through the directional control valve 14, after passing through the bypass conduit 15 (reference orifice 16), and is discharged from the atmospheric vent 12 into the open air.

After this condition is maintained for a predetermined time, the current through the air pump 13 is detected by the current sensor 26 and is determined as a judgment level SL. That is, the current by which the air pump 13 is operated to make the air discharged therefrom be released through the reference orifice 16 of a reference bore size into the open air is determined as the judgment level SL. This program portion corresponds to the judgment level means means.

At step S4, a leak level is measured. Specifically, ① the purge control valve 11 is closed, ② the directional control valve 14 is ON to assume an operative position of connecting the fresh air inlet 9 to the air pump 13, and ③ the air pump 13 is ON. This condition is maintained for a predetermined time. However, the predetermined time at this step is variably set as will be described later.

Figure 6:
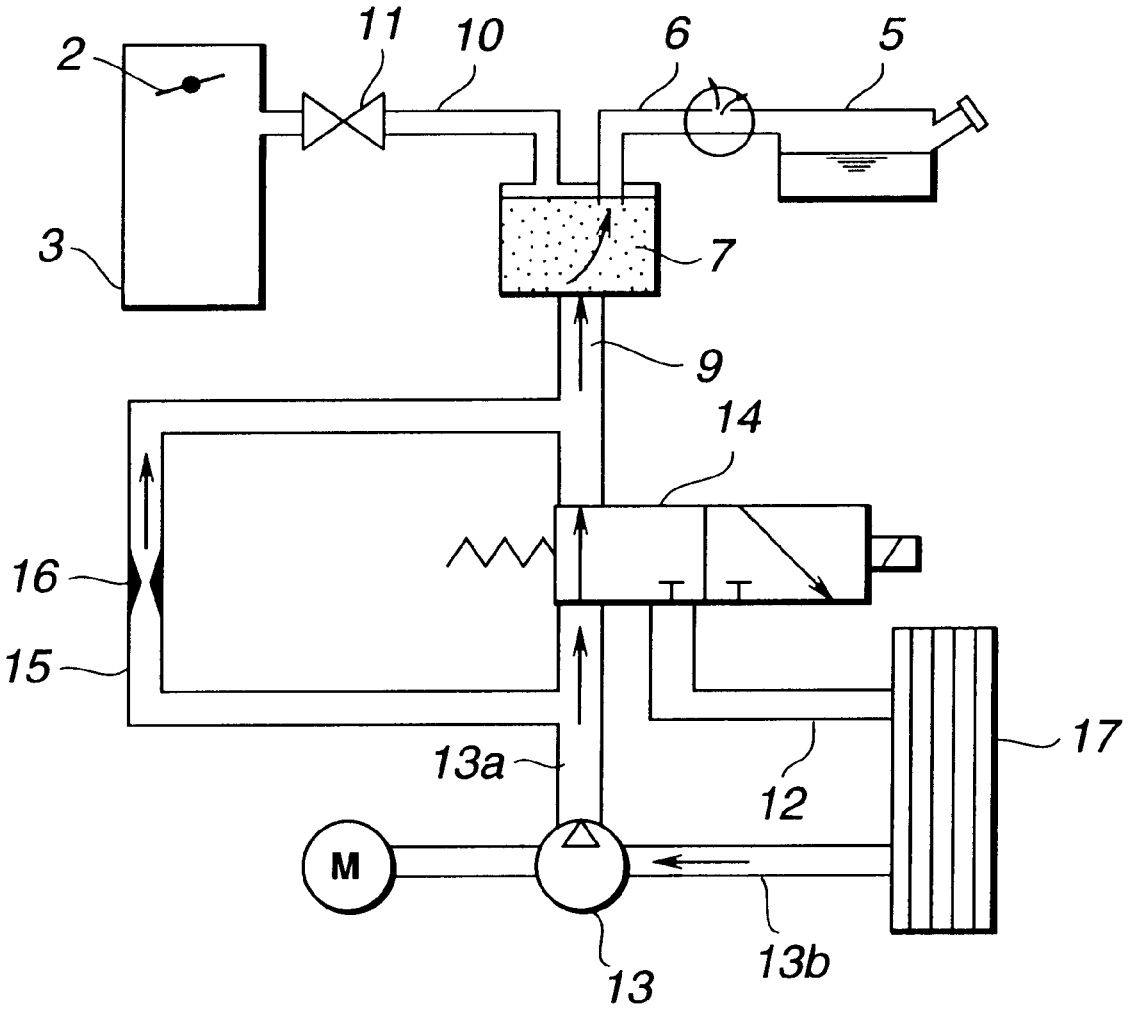
FIG. 6 is a view similar to FIG. 4 but shows flow of air when a leak level is measured.

When this is the case, as shown in FIG. 6, the air discharged from the air pump 13 passes through the directional control valve 14 and the fresh air inlet 9 of the canister 7 into a fuel vapor flow passage 27 which extends from the fuel tank 5 to the purge control valve 11 through the canister 7. Specifically, the fuel vapor flow passage 27 is constituted by the conduits 6 and 10, the inside of the canister 7 and the inside of the fuel tank 5.

After this condition is maintained for a predetermined time, the current through the air pump 13 is detected by the current sensor 26 and is determined as a leak level AL. That is, the current by which the air pump 13 is operated to make the air discharged therefrom be supplied to the fuel vapor flow passage 27 is determined as a leak level SL. This program portion corresponds to the leak level measuring means.

At step S5, the leak level (pump operating current) AL measured at step S4 is compared with the judgment level SL set at step S3 to make a leak detection. When the pump operating current AL is judged as being equal to or lower than the judgment level SL, it is determined that a leak is present, and after a trouble code is set at step S6 the program is completed. When the pump operating current AL is judged as being larger than the judgment level SL, it is determined that there is no leak and the program is completed.

That is, in case the pump operating current at the time of measurement of the leak level AL is smaller as compared with the pump operating current SL necessitated for causing the air discharged from the air pump 13 to pass through the reference orifice 16 of a reference bore size, that is, in case the driving load on the air pump 13 at the time of measurement of the leak level AL becomes smaller as compared with that at the time of measurement of the judgement level SL, it is determined that there exists in the fuel vapor flow passage 27 such a trouble that is equated to formation of an opening that is larger in diameter than the above described reference bore size so there is caused a leak larger than the judgment level SL, otherwise it is determined that there exists no leak, i.e., the evaporative emission control system is normal. This program part corresponds to the leak judging means.

However, in case the current through the air pump 13 increases due to rise of the fuel temperature and increase of the pressure of fuel vapors, there is a possibility of making an erroneous judgment. Thus, the leak level measurement at step S4 is performed in accordance with the flowchart shown in FIG. 3, i.e., by adjusting the measurement timing, an influence of the fuel temperature on the leak detection is avoided for thereby preventing erroneous detection.

Figure 3:
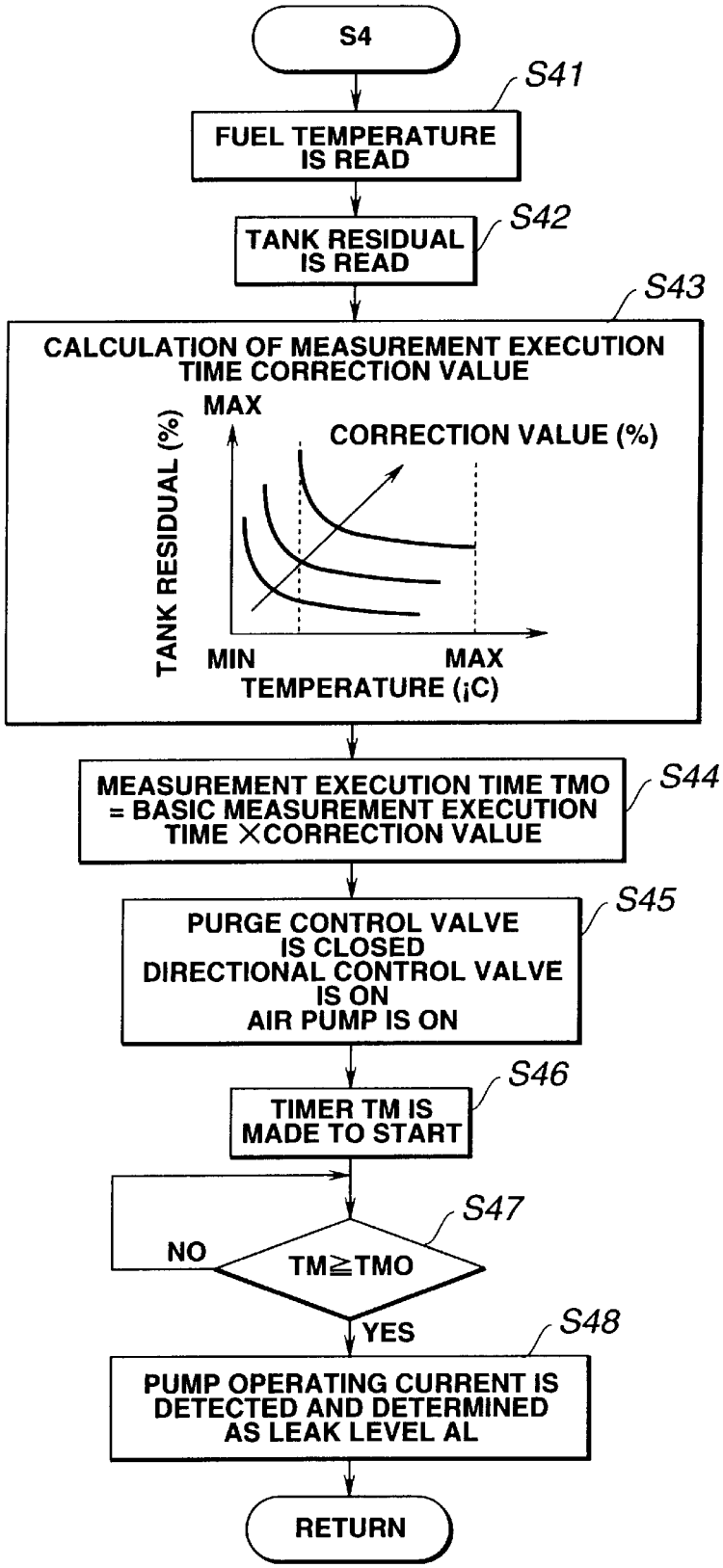
FIG. 3 is a flowchart illustrating the details of a leak level measuring step of the routine of FIG. 2.

The leak level measurement according to the flowchart of FIG. 3 will be described.

At step 41, the temperature of fuel detected by the fuel temperature sensor 24 is read. This program portion corresponds to the fuel temperature detecting means. step S42, the residual quantity of fuel in the fuel tank 5 is read by the tank residual sensor 25. This program portion corresponds to the tank residual detecting means.

At step S43, reference is made to a map wherein measurement execution time correction values are previously set on the basis of the fuel temperature (in the range lower than the upper limit of the detection execution condition) and the tank residual (in the range between the upper and lower limits of the detection execution condition), and the detection execution time correction value is calculated from the actual fuel temperature and the actual tank residual.

At step S44, the measurement execution time TMO is calculated by multiplying the basic measurement execution time by a correction value. In this connection, the program portions at steps S43 and S44 correspond to the measurement timing variable determining means.

At step S45, ① the purge control valve 11 is closed, ② the directional control valve 14 is ON to assume an operative position of connecting the fresh air inlet 9 to the air pump 13, and ③ the air pump 13 is ON.

At step S46, the timer TM is made to start.

At step S47, the value of the timer TM is compared with the measurement execution time TMO and the above described condition at step S45 is maintained until TM≧TMO. When it is attained that TM≧TMO, the program proceeds to step S48.

At step S48, the current through the air pump 13 at this moment is measured by the current sensor 26 and determined as the leak level AL.

In this instance, calculation of the measurement execution time correction value at step S48 is made in such a manner that the correction value (%) is smaller as the fuel temperature is higher or as the tank residual is larger. Thus, as the fuel temperature is higher, the measurement execution time TMD is made shorter. Further, as the tank fuel quantity is larger, the measurement execution time TMO is made shorter.

Figure 7A:
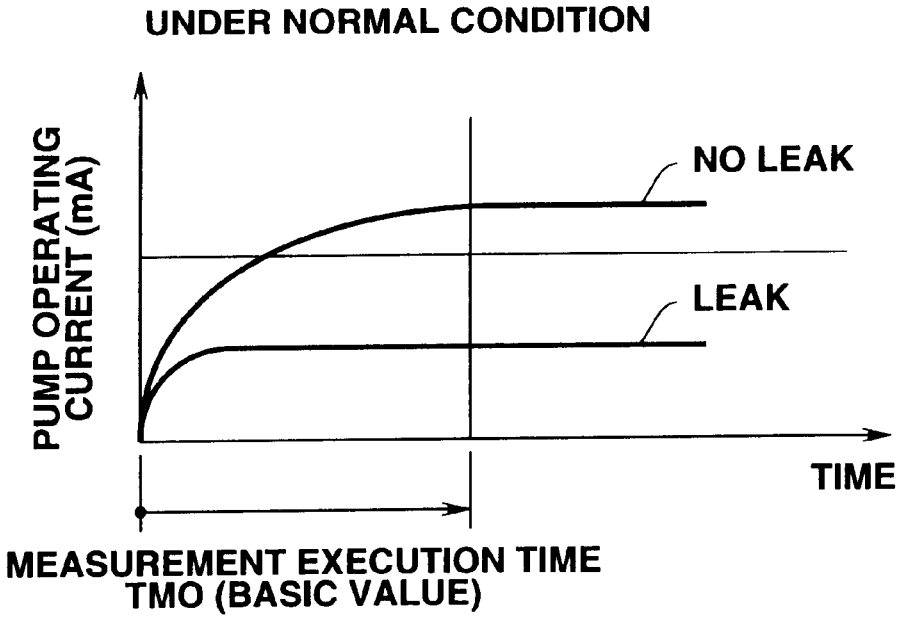
Figure 7B:
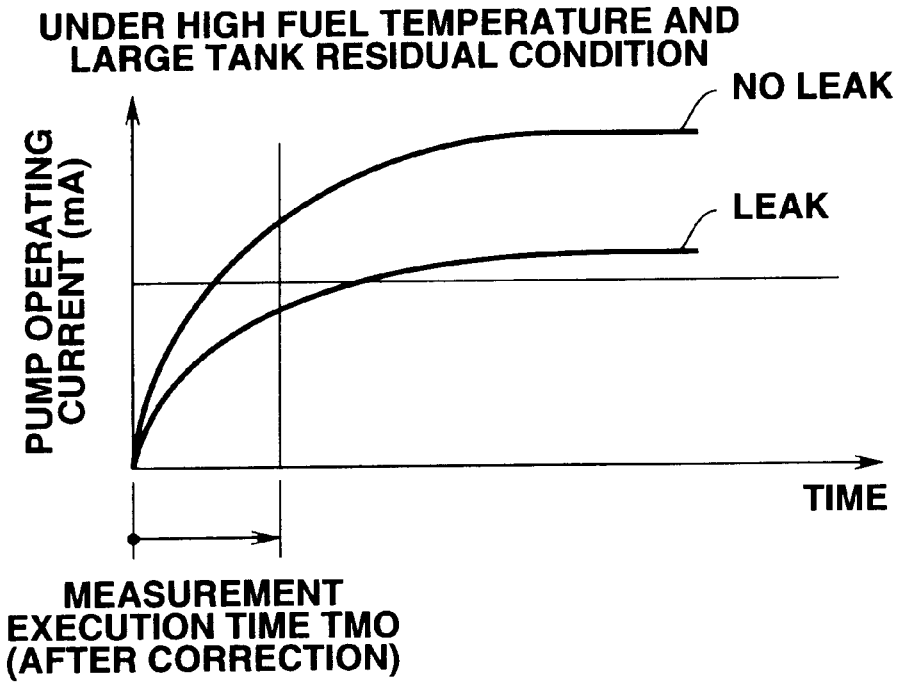

That is, normally (i.e., in case the fuel temperature is low), as shown in FIG. 7A, the measurement execution time is determined as the basic value (basic measurement execution time) which is relatively longer so that the measurement timing is delayed, whereas in case the fuel temperature is high, as shown in FIG. 7B, the measurement execution time is made shorter so that the measurement timing is advanced.

In case the fuel temperature is high, there can possibly occur such a case the current through the air pump 13 becomes gradually larger to exceed the judgment level SL even when a leak is present in the evaporative emission control system. Thus, by advancing the measurement timing so that the measurement is carried out before the pump operating current at the time a leak is present exceeds the judgment level SL, it is intended to prevent erroneous detection.

Further, also in case the tank residual is large, the measurement execution time is made shorter so that the measurement timing is advanced. In case the tank residual is large, the time elapsing before an equilibrium of the pressure is attained becomes shorter. Thus, the measurement timing is advanced so that the measurement is carried out before the pump operating current at the time a leak is present exceeds the judgment level SL, whereby to prevent an erroneous detection.

While in the above described embodiment the measurement timing is determined on the basis of the fuel temperature and the tank residual, the measurement timing can be determined on the basis of only the fuel temperature.

Figure 8:
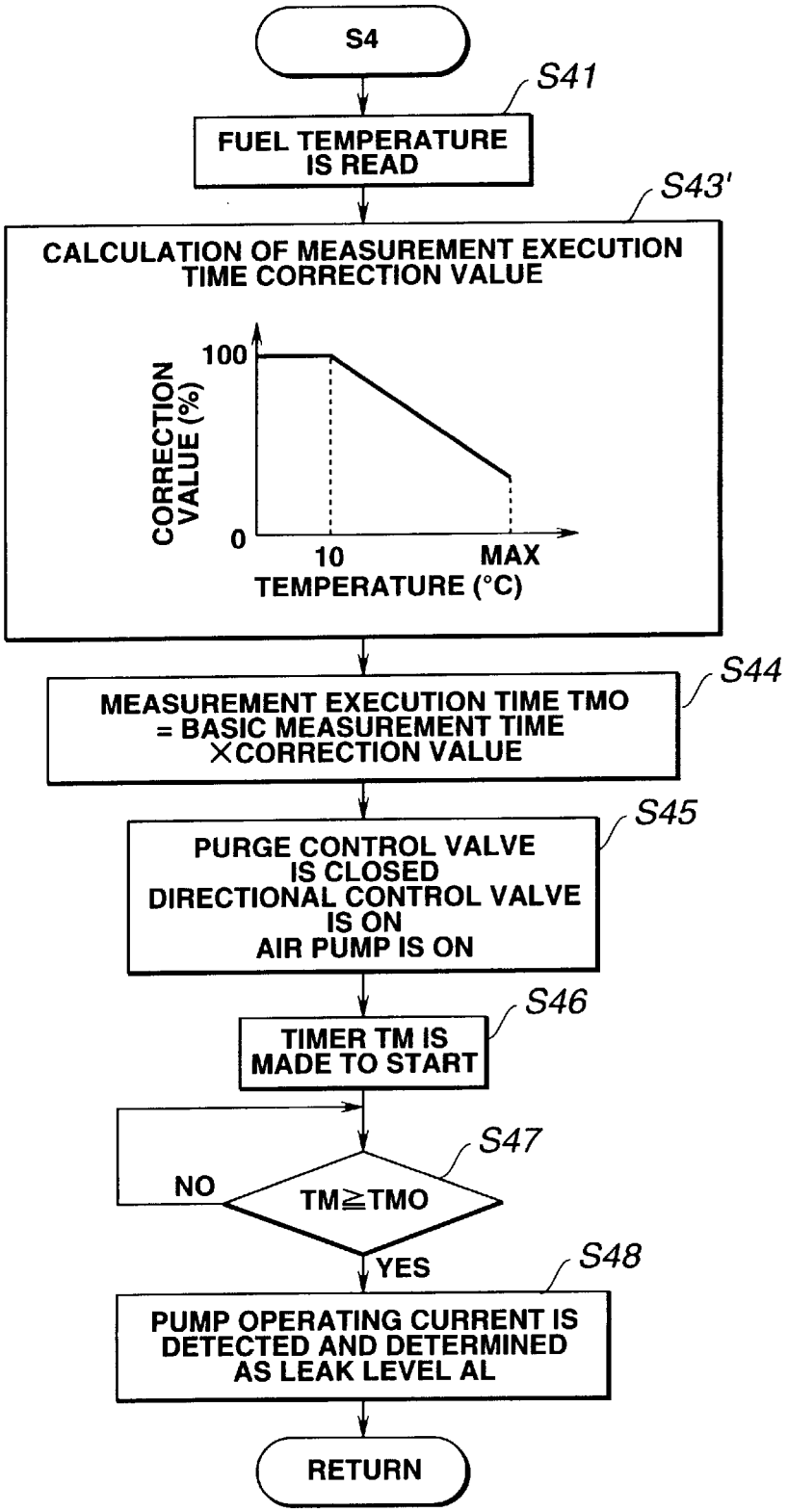
FIG. 8 is a flowchart illustrating the details of a leak level measuring step of the routine of FIG. 2.

The routine for such determination of the measurement timing is shown in the flowchart of FIG. 8. This flowchart differs from that of FIG. 3 in the step S43' and in omitting the step corresponding to step 42.

That is, at step 43', by referring to a table wherein measurement execution time correction values are previously determined on the basis of the fuel temperature, the measurement execution time correction value is calculated from the actual fuel temperature.

In this connection, in case the measurement execution time correction value is calculated at step S43', it is needless to say that by making smaller the correction value (%) as the fuel temperature becomes higher the measurement execution time TMO is made shorter as the fuel temperature becomes higher.

By the above described leak detection, it becomes possible to obviate the influence of the fuel temperature on the leak detection assuredly and thereby improve the detection accuracy. Further, the detection execution time can be made shorter.

While the invention has been described and shown by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. An apparatus for detecting a leak in an evaporative emission control system including a fuel vapor flow passage which extends from a fuel tank to a purge control valve by way of a canister, the apparatus comprising:

a device for defining an atmospheric vent in communication with the open air;

a motor driven air pump having an outlet;

a directional control valve for connecting said fresh air vent selectively to one of said atmospheric vent and said outlet of said air pump;

a bypass conduit providing communication between a fresh air inlet of said canister and said outlet of said air pump while bypassing said directional control valve, said bypass conduit having a reference orifice;

means for detecting a first current through said air pump when said air pump is CN and said directional control valve is in a position of connecting said fresh air inlet to said atmospheric vent;

means for detecting a second current through said air pump after lapse of a predetermined time from establishment of a condition in which said air pump is ON and said directional control valve is in a position of connecting said fresh air inlet to said outlet of said air pump;

means for comparing said second current with said first current and judging if a leak is present in said fuel vapor flow passage;

means for detecting a temperature of fuel in said fuel tank; and means for determining said predetermined time variably on the basis of said temperature of fuel.

2. The apparatus according to claim 1, wherein said means for determining said predetermined time comprises means for making said predetermined time shorter when said temperature of fuel is higher.

3. The apparatus according to claim 1, further comprising means for detecting a residual quantity of fuel in said fuel tank, said means for determining said predetermined time including means for determining said predetermined time on the basis of said temperature of fuel and said residual quantity of fuel.

4. The apparatus according to claim 1, wherein said means for determining said predetermined time comprises means for making said predetermined time shorter when said residual quantity of fuel is larger.

5. An apparatus for detecting a leak in an evaporative emission control system for an internal combustion engine including a fuel tank, a canister for collecting fuel vapors from the fuel tank and having a fresh air inlet, and a purge control valve disposed between the canister and an intake pipe for controlling flow of the fuel vapors from the canister to the intake pipe together with fresh air drawn into the canister through the fresh air inlet such that a fuel vapor flow passage is provided which extends from the fuel tank to the purge control valve by way of the canister, the apparatus comprising:

means for defining an atmospheric vent in communication with the open air;

a motor driven air pump having an outlet;

a directional control valve capable of connecting said fresh air vent selectively to one of said atmospheric vent and said outlet of said air pump;

a bypass conduit providing communication between said fresh air inlet and said outlet of said air pump while bypassing said directional control valve, said bypass conduit having a reference orifice;

judgment level determining means for detecting, when said air pump is ON and said directional control valve connects said fresh air inlet to said atmospheric vent, for thereby allowing air from said air pump to pass through said reference orifice of said bypass conduit and thereafter be released to the open air through said directional control valve, a first current through said air pump and determining said first current as a judgment level;

leak level measuring means for measuring, at a measurement timing after lapse of a predetermined time from establishment of a condition in which said air pump is ON and said directional control valve connects said fresh air inlet to said outlet of said air pump so that air from said air pump passes through said directional control valve and said fresh air inlet of said canister and is supplied to said fuel vapor flow passage, a second current through said air pump and determining said second current as a leak level;

leak judging means for comparing said leak level with said judgment level and judging if a leak is present in said fuel vapor flow passage;

fuel temperature detecting means for detecting a temperature of fuel in said fuel tank; and measurement timing variable determining means for determining said measurement timing variably on the basis of said temperature of fuel.

6. The apparatus according to claim 5, wherein said measurement timing variable determining means comprises means for advancing said measurement timing when said temperature of fuel is higher.

7. The apparatus according to claim 5, further comprising tank residual detecting means for detecting a residual quantity of fuel in said fuel tank, said variable measurement timing determining means including means for determining said measurement timing on the basis of said temperature of fuel and said residual quantity of fuel.

8. The apparatus according to claim 5, wherein said variable measurement timing determining means comprises means for advancing said measurement timing when said residual quantity of fuel is larger.

9. A method of detecting a leak in an evaporative emission control system including a fuel vapor flow passage which extends from a fuel tank to a purge control valve by way of a canister, a device for defining an atmospheric vent in communication with the open air, a motor driven air pump having an outlet, a directional control valve for connecting the fresh air vent selectively to one of the atmospheric vent and the outlet of the air pump, and a bypass conduit providing communication between a fresh air inlet of the canister and the outlet of the air pump while bypassing the directional control valve, the bypass conduit having a reference orifice, the method comprising:

detecting a first current through said air pump when said air pump is ON and said directional control valve is in a position of connecting said fresh air inlet to said atmospheric vent;

detecting a second current through said air pump after lapse of a predetermined time from establishment of a condition in which air pump is ON and said directional control valve is in a position of connecting said fresh air inlet to said outlet of said air pump;

comparing said second current with said first current and judging if a leak is present in said fuel vapor flow passage;

detecting a temperature of fuel in said fuel tank; and determining said predetermined time variably on the basis of said temperature of fuel.

10. The method according to claim 9, wherein said determining said predetermined time comprises making said predetermined time shorter when said temperature of fuel is higher.

11. The method according to claim 9, further comprising detecting a residual quantity of fuel in said fuel tank, said determining said predetermined time including determining said predetermined time on the basis of said temperature of fuel and said residual quantity of fuel.

12. The method according to claim 9, wherein said determining said predetermined time comprises making said predetermined time shorter when said residual quantity of fuel is larger.

13. A method of detecting a leak in an evaporative emission control system for an internal combustion engine including a fuel tank, a canister for collecting fuel vapors from the fuel tank and having a fresh air inlet, a purge control valve disposed between the canister and an intake pipe for controlling flow of the fuel vapors from the canister to the intake pipe together with fresh air drawn into the canister through the fresh air inlet such that a fuel vapor flow passage is provided which extends from the fuel tank to the purge control valve by way of the canister, means for defining an atmospheric vent in communication with the open air, a motor driven air pump having an outlet, a directional control valve capable of connecting the fresh air vent selectively to one of the atmospheric vent and the outlet of the air pump, a bypass conduit providing communication between the fresh air inlet and the outlet of the air pump while bypassing the directional control valve, the bypass conduit having a reference orifice, the method comprising:

detecting, when said air pump is ON and said directional control valve connects said fresh air inlet to said atmospheric vent, for thereby allowing air firm said air pump to pass through said reference orifice of said bypass conduit and thereafter be released to the open air through said directional control valve, a first current through said air pump and determining said first current as a judgment level;

measuring, at a measurement timing after lapse of a predetermined time from establishment of a condition in which said air pump is ON and said directional control valve connects said fresh air inlet to said outlet of said air pump so that air from said air pump passes through said directional control valve and said fresh air inlet of said canister and is supplied to said fuel vapor flow passage, a second current through said air pump and determining said second current as a leak level;

comparing said leak level with said judgment level and judging if a leak is present in said fuel vapor flow passage;

detecting a temperature of fuel in said fuel tank; and determining said measurement timing variably on the basis of said temperature of fuel.

14. The method according to claim 13, wherein said determining said measurement timing comprises advancing said measurement timing when said temperature of fuel is higher.

15. The method according to claim 13, further comprising detecting a residual quantity of fuel in said fuel tank, said determining said measurement timing including determining said measurement timing on the basis of said temperature of fuel and said residual quantity of fuel.

16. The method according to claim 13, wherein said determining said measurement timing comprises advancing said measurement timing when said residual quantity of fuel is larger.

* * * * *